United States Patent [19]

Schneider

[11] 4,013,228

[45] Mar. 22, 1977

[54] FOAM GENERATING SPRAYER APPARATUS

[75] Inventor: Barry L. Schneider, Crystal Lake, Ill.

[73] Assignee: Chemtrust Industries Corporation, Franklin Park, Ill.

[22] Filed: Mar. 23, 1976

[21] Appl. No.: 669,649

Related U.S. Application Data

[63] Continuation-in-part of Ser. No. 523,740, Nov. 14, 1974, Pat. No. 3,946,947, and a continuation-in-part of Ser. No. 396,183, Sept. 11, 1973, abandoned.

[52] U.S. Cl. ..... 239/401; 239/311; 239/428.5; 239/434.5; 239/485

[51] Int. Cl.[2] ..... B05B 1/30; B05B 1/34; B05B 7/04

[58] Field of Search ..... 239/8, 214.25, 302, 239/310, 311, 313, 318, 329, 335, 375, 336, 399, 401, 402.5, 403, 419.5, 428.5, 434.5, 420, 467, 474, 475, 483–485, 526

[56] References Cited

UNITED STATES PATENTS

| | | | |
|---|---|---|---|
| 1,563,123 | 11/1925 | Wade | 239/434.5 |
| 1,605,177 | 11/1926 | Diener | 239/434.5 X |
| 2,760,821 | 8/1956 | Kenney | 239/335 |
| 2,764,452 | 9/1956 | Anderson et al. | 239/310 |
| 3,625,436 | 12/1971 | Wirths | 239/419.5 X |
| 3,797,749 | 3/1974 | Tada | 239/526 X |

*Primary Examiner*—Robert S. Ward, Jr.
*Attorney, Agent, or Firm*—Wallenstein, Spangenberg, Hattis & Strampel

[57] ABSTRACT

A foam generating unit is adjustably mounted for longitudinal movement on a liquid sprayer having an orifice which provides a diverging liquid stream directed into the inlet of the foam generating unit. The foam generating unit includes a foam-generating section most advantageously having a pressure-reducing inlet passageway section including a preferably sharply outwardly tapering portion leading to a throat portion. Air inlet ports are provided communicating with the pressure-reducing passageway, through which ports air is drawn by the reduced pressure caused by the pressure-reducing passageway. The desired foaming action is achieved by adjusting the points of the pressure-reducing passageway section struck by the stream by moving the foam generating unit relative to the orifice.

10 Claims, 6 Drawing Figures

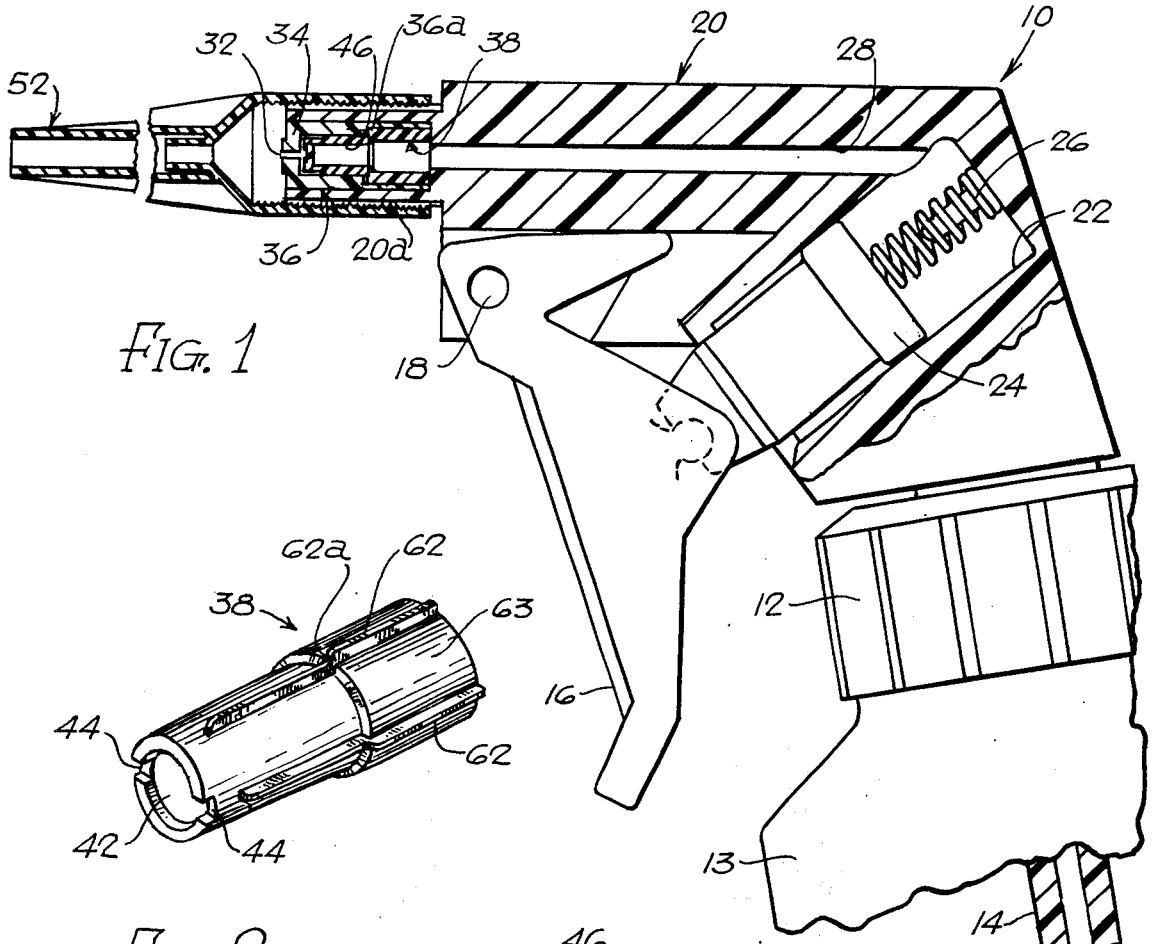
FIG. 1
FIG. 2
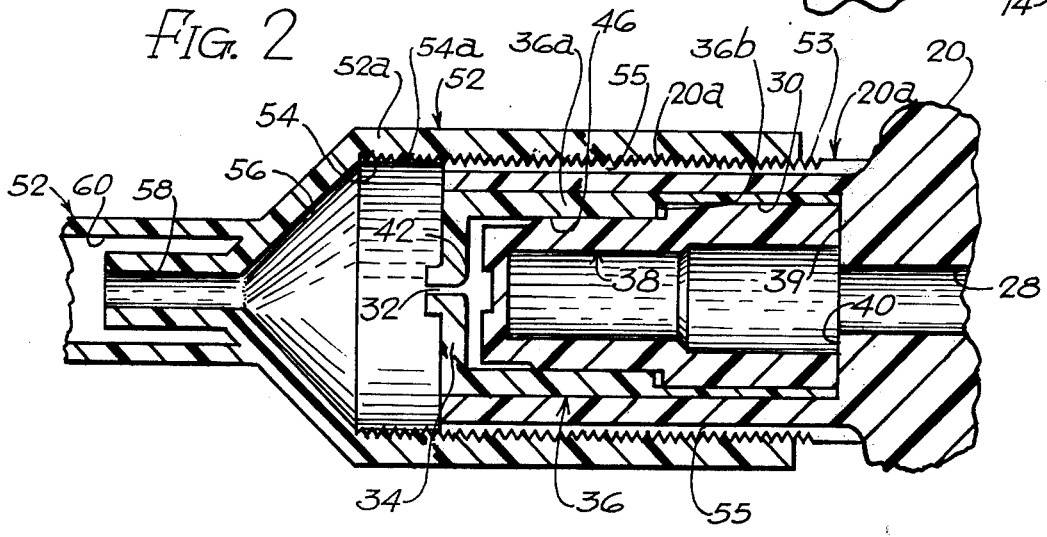
FIG. 3

FOAM GENERATING SPRAYER APPARATUS

RELATED APPLICATION

This application is a continuation-in-part of application Ser. Nos. 523,740, filed Nov. 14, 1974, entitled, FOAM GENERATING APPARATUS, now U.S. Pat. No. 3,946,947, issued Mar. 30, 1976 and 396,183, filed Sept. 11, 1973, and entitled, FOAM GENERATING APPARATUS, now abandoned.

BACKGROUND OF THE INVENTION

The present invention relates to foam generating nozzles which, while having application for the dispensing of a wide variety of chemicals, has its most important application in the dispensing of cleaning chemicals.

The application of chemicals in a foamed condition is frequently desirable for a number of reasons. Thus, it permits the application of chemicals with lower spray rates and active chemical content with the advantage of reduced costs. Also, especially when spraying vertical or downwardly facing horizontal surfaces, maximum contact time of the foamed material on the surface involved is achieved. Additionally, it eliminates the health and safety hazards caused frequently by liquid sprays which by splashing or otherwise forms tiny droplets or a fine mist which is inhaled and strikes the eyes to cause great discomfort and sometimes serious harm to the persons involved. The application of the material in a foamed state reduces or eliminates the tiny droplets or mist formation which causes these health and safety hazards.

The application of agricultural chemicals by spraying from airplanes and the like by foam generating equipment including a nozzle unit which mixes air with the liquid chemical is well known. Occasionally, cleaning chemicals have been applied by foam-producing aerosol and other type dispensing units. Also, the foaming of a mixture of water and a foaming agent issuing from a nozzle is in common use by firemen.

Many materials such as soaps can be readily foamed by mild agitation, and other materials are more difficult to apply in the foamed condition. Foaming agents can sometimes be added to the latter materials to increase their foamability when agitated by passage through an aerosol nozzle or when mixed with air in an aerating nozzle.

The type of foam spray obtained by a particular foam generating nozzle unit is a function of a number of factors, such as the nature of the material being sprayed, the pressure of the material when applied to the nozzle unit and the design of the nozzle unit. Also, the desired consistency of the foam to be developed by a particular nozzle unit depends upon the particular application involved. Usually, for applications involving a prolonged desired retention on vertical and downwardly facing horizontal surfaces, it is desirable to apply the material involved as a thick foam. Thick foams usually comprises small bubbles which have a maximum penetrating power for porous surfaces. In some applications, the throw of the stream produced by the nozzle is important to make it convenient to cover large areas with the foam product quickly and easily. With some foam generating nozzle units having an adjustment of foam thickness, the desired thickest foam is achieved at a serious sacrifice of stream throw, and so a compromise must be made involving both foam thickness and stream throw considerations. It is advantageous, therefore, that a given foam generating nozzle unit be adjustable to provide the desired degree of foaming action, preferably without much sacrifice of stream throw.

One foam generating sprayer heretofore developed and over which the present invention is an improvement is the spray assembly disclosed in U.S. Pat. No. 3,918,647, granted Nov. 11, 1975. The foam sprayer disclosed therein provides a progressive control over the degree and quality of foaming action achieved with a unique foam generating nozzle unit of the air aspirating type by varying the angle of divergence of a liquid stream issuing from an orifice directed into a pressure-reducing passageway including most advantageously a sharply outwardly tapered portion terminating in a restricted throat passageway portion opening into an expansion chamber. The narrowest useful stream flowing from the orifice is a relatively concentrated liquid stream which initially strikes the walls of the throat passageway portion to produce a stream with a long throw but with a modest degree of foam. By progressively increasing the angle of the stream flowing from the orifice, the stream becomes less concentrated and progressively more mist-like and strikes greater extents of the pressure-reducing passageway including said tapered portion thereof. An unexpectedly sudden increase in foaming action occurs with only an insignificantly modest reduction in the spray throw when the widest portion of the diverging stream issuing from the orifice strikes the end section of the tapered portion of the pressure-reducing passageway. Such a spray pattern was found generally to produce foam with good throw. However, even thicker foams were achieved when the widest portion of the diverging stream initially strikes the pressure-reducing passageway at points substantially behind the end section of the tapered passageway portion but the progressively thicker foams are achieved with progressively reduced throws which reach impractical magnitudes after only a small adjustment.

Many prior art non-foaming sprayers provide for the progressive variation of the angle of divergence of a liquid stream emanating from an orifice by the rotation of a member forming the orifice. The rotatable member is usually threaded over the head of the sprayer and the spray angle is varied as the orifice is variably spaced from another orifice within the sprayer head. It usually takes only a small fraction of a revolution of the rotatable orifice-forming member to vary the spray pattern from the narrowest to the widest angle of divergence involved. The use of such an adjusting means in a foam producing sprayer of the kind just described makes the adjustment for an optimum foam quality a burdensome and sometimes difficult operation.

It is, accordingly, an object of the present invention to provide an improvement in the foam generating spray apparatus disclosed in said U.S. Pat. No. 3,918,647, which provides a less sensitive more easily adjusted control for varying the foam quality in foam producing sprayers.

Another object of the present invention is to provide a spray generating nozzle unit which provides for an easily controlled variation in the areas of a foam producing passageway struck by a stream issuing from an orifice, to enable the user readily to achieve an optimum desired degree of foaming with substantial throw distances, where desired.

SUMMARY OF THE INVENTION

In the present invention, the angle of the diverging liquid stream emanating from the aforementioned orifice is more or less fixed at an angle which is preferably a relatively small angle of about 20°, where the liquid stream is fairly concentrated (that is, it is not a fine mist as in the case with the much wider angles are used), and the adjustability of the areas of the presure-reducing passageway struck by the diverging stream is achieved by bodily moving the foam generating nozzle unit relative to the orifice. In such case, the nozzle unit must be moved axially a substantial distance in comparison to the distance the said orifice-forming member had to be moved to encompass the useful limits of adjustability. Thus, when the nozzle unit of the present invention is threaded over a support member, a large number of turns of the nozzle unit is required to move the same over the useful range of adjustability.

More importantly, since the characteristics of the diverging stream are not varied during the adjustment described, the stream discharged from the orifice at all times has a reasonably desired high degree of liquid concentration, so that more appreciable throws of the foam stream issuing from the sprayer is achieved over a greater proportion of the adjustment of the foam generating nozzle unit, so that thicker foams for a given throw distance can be achieved.

The above described and other advantages and features of the present invention will become apparent upon making reference to the specification to follow, the claims and the drawings.

DESCRIPTION OF DRAWINGS

FIG. 1 is a fragmentary partly broken away view of a bottle containing liquid to be sprayed and a hand operated trigger sprayer which is removably connected to the top of the bottle involved and which includes the nozzle unit constituting the most preferred form of the present invention.

FIG. 2 is a perspective view of a fluid-directing member forming part of the sprayer of FIG. 1;

FIG. 3 is a greatly enlarged fragmentary sectional view through the foam producing portions of the sprayer of FIG. 1 before the trigger lever has been compressed;

DESCRIPTION OF PREFERRED EMBODIMENT OF INVENTION

Figure 4:
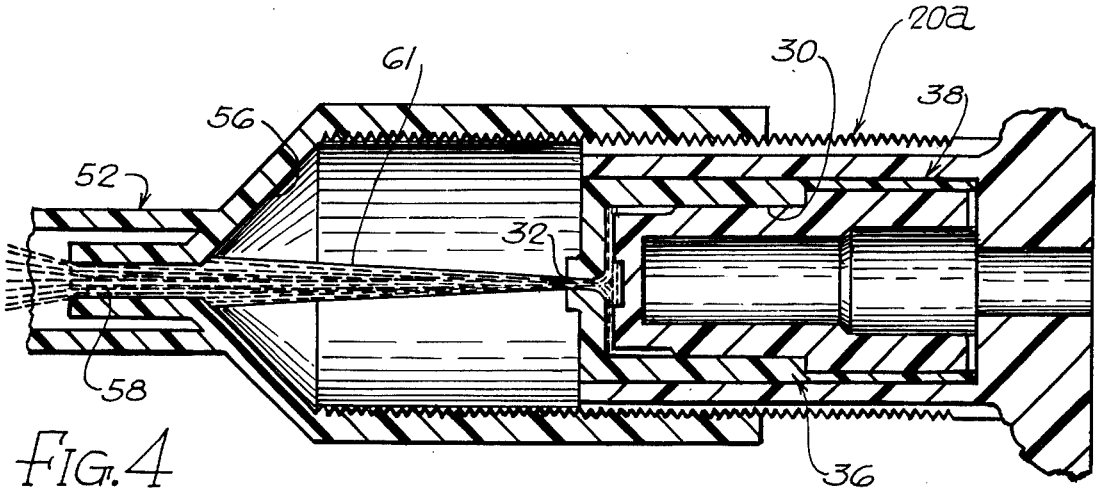
FIG. 4 is a view corresponding to FIG. 3 after the trigger lever has been compressed to cause liquid to flow through the sprayer, and shows the position of an adjustable nozzle unit which produces relative thick foam but with less than the greatest amount of throw.

Refer now more particularly to FIG. 1 which shows the present invention applied to a sprayer 10 like the non-foaming hand trigger sprayer shown in U.S. Pat. No. 3,685,739 granted Aug. 22, 1972. The hand trigger sprayer 10 has an internally threaded collar 12 adapted to thread over the neck of a container 13. Depending downwardly from the collar 12 is an inlet tube 14 through which liquid is drawn from the container in the manner disclosed in said U.S. Pat. No 3,685,739, upon the squeezing of a lever 16 pivoted at a point 18 to the main body 20 of the sprayer.

The main body 20 of the sprayer includes a liquid-receiving chamber 22 in which is mounted a piston member 24 urged by a spring 26 into an outer position. When the lever 16 is squeezed, piston 24 compresses the spring 26 and reduces the size of the chamber 22 so that liquid delivered to the chamber 22 will be forced through a first longitudinal passageway 28 opening onto an enlarged passageway 30 communicating with a discharge orifice 32 formed in the head portion 34 of an insert member 36. Mounted for limited longitudinal movement in the passageway 30 is a liquid-directing member 38. The main body 20, as well as insert member 36 and liquid-directing member 38 may be molded of any suitable synthetic plastic material.

The liquid-directing member 38 has flat rear face 39 adapted to engage and seal about shoulder 40 surrounding the point at which the passageway 28 opens onto the passageway 30, when the lever 16 is in its uncompressed position. The force of the liquid flowing from the chamber 22 upon squeezing of the lever 16 forces the liquid-directing member 38 forwardly in the passageway 30, permitting the flow of liquid around the fluid-directing member 38.

The liquid-directing member 38 has a small shallow recess 42 in the front wall thereof opening onto the lateral sides of the member through entryways 44—44. The original purpose of the recess 42 and entryways 44—44 is to permit liquid to gain access to the orifice 32 should this member be permitted to move fully forwardly within the passageway 30, as in the case of the design of the sprayer before the modifications thereto in accordance with the present invention were made.

The passageway 30 is defined by the cylindrical interior 46 of the insert member 36 which has a cylindrical skirt portion **36*a* friction fitted or otherwise secured within a cylindrical externally threaded extension 20*a* of the sprayer body 20. The skirt portion 36*a* of the insert member defines a rearwardly facing interior shoulder 36*b*** having a function to be explained.

The head portion 34 of the insert member 36 is shown projecting slightly outside of the sprayer body 20, and a foam-producing nozzle unit 52, which may be molded of synthetic plastic material, is threaded on the threaded exterior portion 53 of the cylindrical extension **20*a* of the sprayer body 20. The foam-producing nozzle unit 52 has a cylindrical head portion 52*a* with a threaded inner wall surface 54*a* engaging the threaded exterior portion 53 of the sprayer body extension 20*a*. The threaded inner wall surface defines an inlet chamber 54 into which the orifice 32 of the insert member 36 opens. The threads of the cylindrical sprayer body extension are longitudinally slotted at a number of points, such as 90° spaced apart points 55, to provide axial air inlet passageways extending from the base of the sprayer body extension to the outer end thereof, where they communicate with the inlet chamber 54. The threading on the sprayer body extension 20*a* terminates short of the inner end thereof, so the foam-producing nozzle unit cannot be rotated to a point where it shuts off the inner ends of the air inlet slots at 55** from the surrounding atmosphere.

The inlet chamber 54 of the nozzle unit 52 terminates in a pressure-reducing passageway which, most advantageously, includes a sharply forwardly tapered passageway portion 56 which, in turn, terminates in a cylindrical throat portion 58 opening onto an expansion chamber 60. The liquid stream 61 (FIGS. 4–6) passing into the inlet chamber 54 has a forwardly diverging angle of preferably about 15°–25°, and most preferably about 20° for the particular sprayer illustrated. The pressure-reducing passageway is sized so that the widest portion of the stream 61 will strike various parts of the tapered passageway portion 56 including the end section thereof and also preferably the interior of the throat portion 58, for the various possible positions of adjustment of the nozzle unit, as shown, for example, by the different positions thereof in FIGS. 4–6.

The angle of the stream 61 issuing from the orifice 32 is a function of the spacing between the inner surface of the recess 42 in the front face of the fluid-directing member 38 and the orifice 32. If the front of the fluid-directing member 38 shown is against the head portion 34 of the insert member 36, the angle of the stream diverging from the orifice 32 will probably not be at a desired angle to strike the desired portions of the tapered portion 56 of the pressure-reducing passageway of the nozzle unit 52. The fluid-directing member 38 is provided with radially extending movement guiding ribs 62 (FIG. 2) which define liquid passage spaces 63 therebetween. The ribs 62 are provided with shoulders **62*a* which strike the shoulder 36*b* in the skirt portion 36*a* of the insert member 36 when the front face of the fluid-directing member 38 reaches the proper spacing from the head portion 34 of the insert member 36** which provides the most desired angle for optimum foaming action and spray throw.

Figure 5:
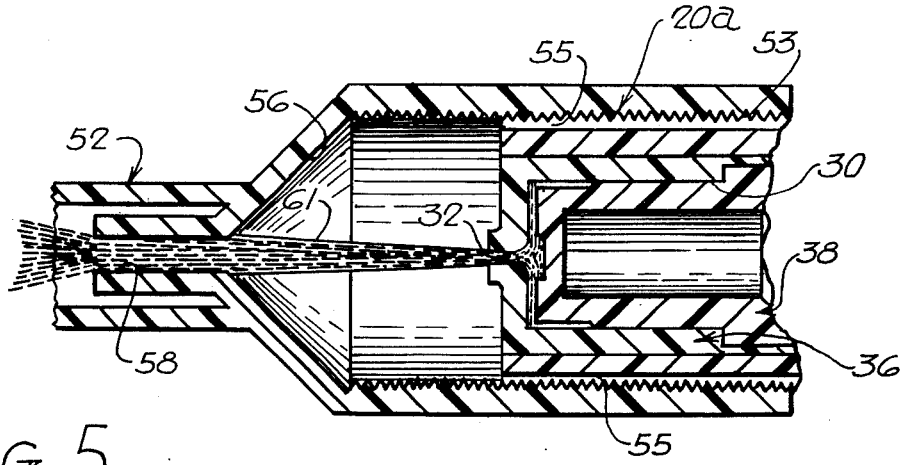
FIG. 5 is a view corresponding to FIG. 4 where the nozzle unit has been adjusted to produce somewhat less thick foam but with greater throw.
Figure 6:
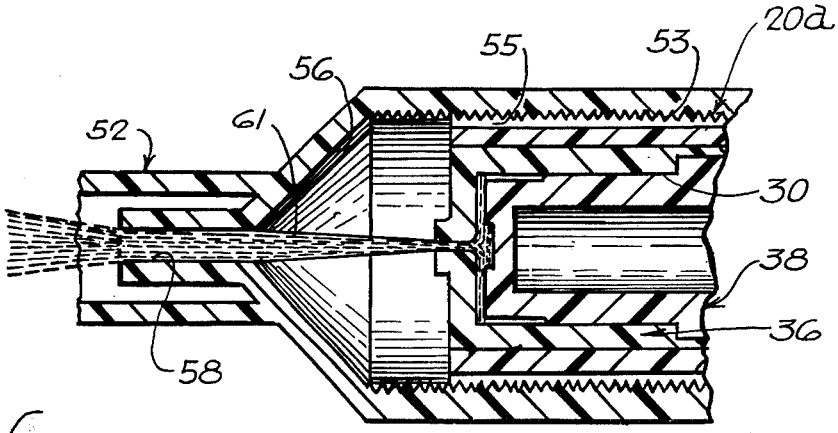
FIG. 6 is a view corresponding to FIG. 4 where the nozzle unit is adjusted to produce a relatively thin foam.

As previously indicated, and as shown in FIGS. 4–6, a significant degree of movement of the foam-producing nozzle unit 52 is required to vary the useful adjustable points of the pressure-reducing passageway struck by the widest portion of the relatively concentrated liquid stream emanating from the orifice 32. This movement requires a number of turns of the nozzle unit 52.

The angle of divergence of the stream emanating from the orifice 32 is not only a function of the relative spacing of the fluid-directing member 38 in its forwardmost position from the orifice 32, but it is also somewhat a factor of the characteristics and particularly the viscosity of the spray material involved. Thus, the adjustable foam-producing nozzle unit of the invention may be conveniently used for the purpose of either varying the characteristics of the foam spray of a fixed material or for the purpose of obtaining with different materials a given desired foam quality. Thus, if the desired characteristics is always the thickest foam with an appreciable throw, the present invention has utility to effect this end with a variety of spray materials having substantially different viscosities. On the other hand, where the adjustable foam-producing nozzle unit of the invention is always utilized by a given user for the same material, the advantage of the invention is primarily in giving the user an adjustment over the degree of foaming action obtained. Accordingly, if for a given application it is desired to have little or no foaming action, the foam-producing nozzle unit is adjusted so that the widest portion of the diverging stream strikes the interior of the throat portion 58 of the nozzle unit, as shown in FIG. 6. As previously indicated, optimum foaming action with maximum throw is generally obtained when the widest portion of the stream issuing from the orifice 32 strikes the end portion of the tapered passageway portion 52, as shown in FIG. 5. The adjustment of the foam producing unit shown in FIG. 4 produces a thicker foam, with somewhat reduced throw, from that obtained when the widest portion of the diverging stream strikes the end section of the tapered portion 52, as shown in FIG. 3.

While the present invention has applicability to foam-producing nozzle units having a variety of different foam-producing passageway configurations, it is believed that the best foaming action is achieved with the succession of passageways shown for the foam-producing nozzle unit 52, as illustrated. In this preferred form of the invention, the tapering portion **56*a*** of the pressure-reducing passageway of the nozzle unit is sharply tapered so as to subtend an angle of about at least about 60° where the walls thereof incline at least about 30° to the longitudinal axis.

A greatly increased foaming action is achieved by providing the expansion chamber 60 beyond the point where the pressure-reducing passageway terminates, that is beyond the throat portion 58. The expansion chamber 60 appears to have little or no effect in creating an overall enhanced foaming action when the liquid discharged from the throat portion 58 has not yet been appreciably foamed, so that the main benefit of the expansion chamber is in its combination with a foam producing passageway.

While the length to diameter ratios of the various passageways and chambers described may vary widely, there are extremes of these ratios which can seriously adversely affect the operability of the foam-producing nozzle unit 52. For example, the length to diameter ratio of the throat portion 58 of the pressure reducing passageway of the nozzle unit 52 illustrated is approximately between 3 or 4 to 1. If the length of the throat portion illustrated were to be greatly extended, while a greater contact time between the liquid and the pressure reducing passageway may cause an increased foam thickness, the frictional forces involved can reduce the flow velocity to a point where the foamed material may be discharged with insufficient force to travel to the surface to be cleaned. Similarly, if the length to diameter ratio of the expansion chamber 60 were to be increased materially from an optimum length, the frictional forces involved would reduce the velocity of the foamed material discharged from the end of the nozzle attachment to a point where an inadequate quantity of the material will reach the surface to be cleaned. The expansion chamber 60 has a diameter preferably at least about twice the diameter of the throat portion 58, and a length to diameter ratio falling in the range of about from 7 to about 20, and most preferably between about 10 to 16.

It should be understood from what has been stated above that numerous modifications may be made in the most preferred form of the invention shown in the drawings and described without deviating from the broader aspects of the invention.

I claim:

1. An adjustable foam generating sprayer comprising, in combination: sprayer body means defining an inlet section through which liquid can pass, said inlet section including outlet orifice-forming means through which liquid passes for providing a diverging stream flowing therefrom; and a foam-producing nozzle unit having a foam-producing section adjacent to and downstream from said outlet orifice-forming means which foam-producing section has an inlet end which receives the entire variably shaped stream issuing from said outlet orifice-forming means, air inlet portforming means in communication with the exterior of the sprayer, and foam-producing passageway means communicating with said air inlet port-forming means and said inlet end of the nozzle unit for effecting the aspiration of air through said air inlet port-forming means and the mixing thereof into the liquid stream as the stream through said foam-producing passageway means, said foam-producing nozzle unit being adjustably mounted on said sprayer body means for movement toward and away from said outlet orifice-forming means, thereby to vary the portions of the passageway means struck by the stream, which, in turn adjusts the quality of the foam of the stream flowing from the nozzle unit.

2. The sprayer of claim 1 wherein said passageway means includes an outwardly tapered portion merging with a throat portion.

3. The sprayer of claim 2 wherein said passageway means is positioned with respect to said orifice-forming means so the diverging stream issuing from the latter strikes progressively increasing areas of said outwardly tapered and throat portions of said pressure-reducing passageway means as the position of said nozzle unit is adjusted.

4. The sprayer of claim 2 wherein the spacing of said orifice-forming means from said tapered portion of said pressure-reducing passageway means is such that the diverging stream issuing therefrom strikes progressively increasing areas of said tapered portion of said passageway means as the position of the nozzle unit is adjusted.

5. The sprayer of claim 3 wherein said nozzle unit is rotatably threaded over a portion of said sprayer body means so it must be rotated a number of revolutions to position said diverging stream to strike said areas of said tapered and throat portions of said passageway means.

6. The sprayer of claim 1 wherein said sprayer body means has an externally threaded cylindrical extension, said in orifice-forming means being positioned radially inwardly thereof, a foam-producing nozzle unit having an internally threaded cylindrical inlet chamber whose defining walls are threaded over said externally threaded cylindrical extension of the sprayer body means, said inlet chamber of said nozzle unit merging with said foam-producing passageway means.

7. The sprayer of claim 6 wherein said foam-producing passageway means comprises a forwardly tapering portion merging with a throat portion.

8. The sprayer of claim 6 wherein the said externally threaded cylindrical extension of said sprayer body means has at least one longitudinal continuous slot formed in the threads thereof extending from the outer end portion thereof to a point where it communicates with the exterior of the sprayer, said slot forming said air inlet port-forming means.

9. The sprayer of claim 4 wherein said tapered portion of said foam-producing passageway means tapers sharpley at an angle of at least about 30° relative to the longitudinal axis thereof.

10. The sprayer of claim 1 wherein said inlet end of said body means defines a first passageway terminating in an end opening onto a second passageway terminating in said orifice-forming means, a fluid-directing member mounted for longitudinal movement in said second passageway between a position where suction at the inlet end draws the same into sealing relationship with the end of said first passageway and a second position under conditions of fluid pressure, permitting passage of liquid from said first passageway to the orifice-forming means at the end of said second passageway where a diverging stream of a desired angle is obtained.

* * * * *